United States Patent [19]

Gerke et al.

[11] Patent Number: 4,897,040

[45] Date of Patent: Jan. 30, 1990

[54] CUTTING AND CLAMP SLEEVE CONTACT AND METHOD OF CONNECTING INSULATED ELECTRICAL WIRE CONDUCTORS

[75] Inventors: Dieter Gerke; Manfred Müller, both of Berlin, Fed. Rep. of Germany

[73] Assignee: Krone Aktiengesllschaft, Berlin, Fed. Rep. of Germany

[21] Appl. No.: 170,881

[22] Filed: Mar. 21, 1988

[30] Foreign Application Priority Data

Mar. 20, 1987 [DE] Fed. Rep. of Germany ..... 3709376

[51] Int. Cl.[4] ..... H01R 4/24

[52] U.S. Cl. ..... 439/401; 439/392; 439/399

[58] Field of Search ..... 439/391–413, 439/417

[56] References Cited

U.S. PATENT DOCUMENTS

| | | | |
|---|---|---|---|
| 3,845,455 | 10/1974 | Shoemaker | 439/391 |
| 4,141,618 | 2/1979 | Reavis, Jr. et al. | 439/406 |
| 4,283,105 | 8/1981 | Ferrill et al. | 439/406 |
| 4,580,870 | 4/1986 | Gerke | 439/883 |

*Primary Examiner*—David Pirlot

*Attorney, Agent, or Firm*—McGlew & Tuttle

[57] ABSTRACT

The invention relates to a cutting and clamping sleeve contact for contacting a cable wire laterally to the sleeve axis. The sleeve contact exhibits at least one clamping through slot at the periphery of the sleeve and a cutting and clamping contact in the interior of the sleeve. Wall pieces are cut free at the wall of a sleeve. They provide a one-piece sleeve contact suitable to contact cable wires having varying diameters and multi-stranded conductors. The wall pieces are also made of a metal material, and are bent into the interior of the sleeve and form contact legs for forming the cutting/-clamping contact.

17 Claims, 4 Drawing Sheets

CUTTING AND CLAMP SLEEVE CONTACT AND METHOD OF CONNECTING INSULATED ELECTRICAL WIRE CONDUCTORS

BACKGROUND OF THE INVENTION

1. Field of the Invention

This invention relates, in general, to connection of insulated conductors and, in particular, to a new and useful apparatus for effecting a cutting-away of insulation and the establishment of a contact over electrical connectors and to a method of effecting an electrical connection and to a blank element for effecting a clamping sleeve contact for contacting a cable wire laterally to the contact sleeve axis, particularly for cable wires and telecommunications.

A similar cutting and clamping sleeve contact is known from German Pat. No. 32 36 867. This cutting and clamping sleeve contact consists of a sleeve made from plastic, at the periphery of which two clamping slots with a latch position are provided, and of a metal cutting/clamping contact with a contact slot. It is, thus, a two-piece system. When pressing an insulated wire into the contact slot, the opposite sharp edges of the contact slot cut first through the wire insulation and penetrate then into the conducting core of the wire. By means of cutting and clamping sleeve contacts, insulated wires can thus, be connected without screws, soldering and wire-stripping. The cutting and clamping sleeve contact can be mounted free-standing on a surface or in a housing. To this sleeve contact, only cable wires having a certain diameter can be connected, as the cable diameter to be connected depends on the slot width of the contact slot and of the clamping slot.

SUMMARY OF THE INVENTION

The invention provides a cutting and clamping sleeve contact by means of which cable wires with varying diameters and stranded conductors can be contacted and which is a one-piece system.

According to the invention, in the cutting and clamping sleeve contact, wall pieces are cut out from the wall of the sleeve made of a metal material, and the pieces are bent inward into the interior of the sleeve and form contact legs for forming the cutting and clamping contact.

Thus, cable wires having varying diameters can be connected. With thicker cable wires, a widening of the contact slot is caused, as the clamping slot widens correspondingly, too. For this reason, higher contact forces result, which are necessary for good contacting. The cutting and clamping sleeve contact has a contact slot adaptable to varying cable diameters with adaptable contact forces. By the clamping slot, furthermore, the mechanical stresses acting on the cutting and clamping sleeve contact are kept away from the contact slot. Therefore, additional clamping ribs outside the sleeve contact are not necessary.

The sleeve cross section can have any shape. With a square cross section, e.g., the sleeve can, thus, be mounted in non-rotatable manner in a plastic housing.

A high contact safety is achieved, when the contact legs are arranged under an angle of approximately 45° to the cable wire axis, such that the sharp edges of the contact slot formed by the contact legs penetrate into the conducting core of the cable wire at two positions being diagonally opposite to each other.

In another embodiment, the contact legs are formed as angular wall pieces, such that a surface contact results.

This surface contact offers the possibility to connect stranded conductors to the cutting/clamping sleeve without damaging or cutting individual wires.

Accordingly, it is an object of the invention to provide an electrical connector for cutting away insulation and clamping electrical insulated wire conductors which comprises a substantially tubular member having open ends and an axially extending through slot extending from one end to the other and including a pair of substantially diametrically opposite conductor entrance aligning guide slots defined at one of the ends of the tubular member, with one slot defining an entrance guide into the through slot and including a wall piece located immediate the length of the tubular member which is electrically connected to the tubular member and is advantageously formed integral therewith and projects into the interior of the tubular member and terminates in spaced-apart wall piece conductor edges, the entrance aligning guides orienting the wire conductor which is placed into and moved downwardly along the through slot so that its insulation is penetrated by the conductor edges and its wire conductor is electrically connected to the wall piece conductor edges.

A further object of the invention is to provide a method of effecting an electrical connection of an insulated wire conductor using a cutting and connecting sleeve member which has a slot extending down the length thereof and interior electrical contacting portions which extend into the tube from respective sides and define cutting and contacting edges which includes placing the wire across the tubular member in the aligning guide slots, moving the wire downwardly in the through guide slot until it gets between the edges of the wall pieces and pushing the wire through the wall pieces so that the insulation is cut and the conductor is connected to the respective inwardly projecting edges of the wall pieces.

A further object of the invention is to provide a sling for forming a combination cutting and clamping electrical insulating wire connector.

A further object of the invention is to provide a cutting and clamping electrical insulated wire connector which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DESCRIPTION OF THE PREFERRED EMBODIMENTS

Figure 1:
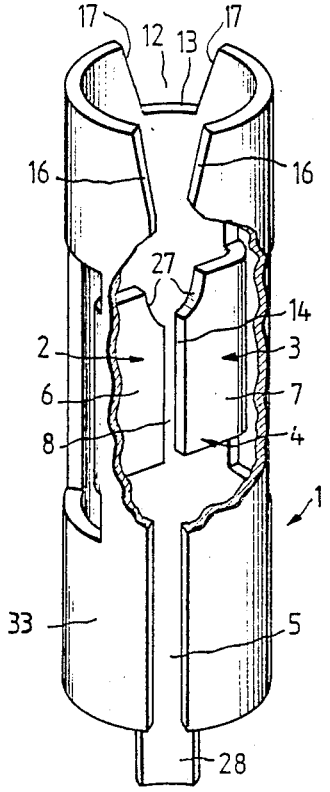
FIG. 1 is a front top perspective view, partly broken away, of a first embodiment of the cutting/clamping sleeve contact constructed in accordance with the invention.
Figure 2:
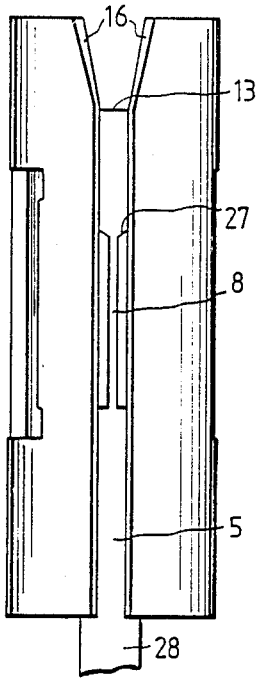
FIG. 2 is a front elevational view of the contact shown in FIG. 1.
Figure 3:
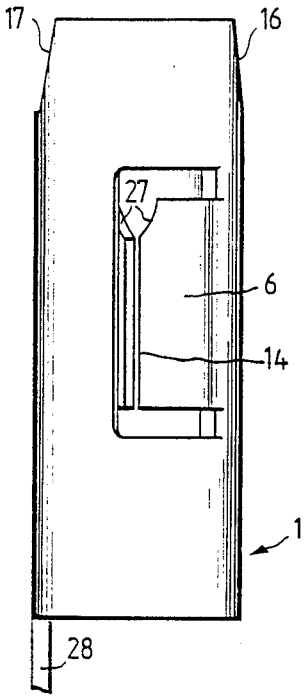
FIG. 3 is a side elevational view of the contact shown in FIG. 1.
Figure 4:
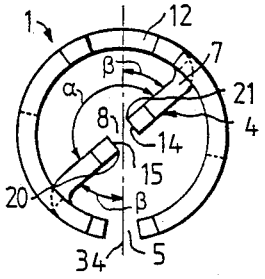
FIG. 4 is a top plan view of the contact of FIG. 1.
Figure 5:
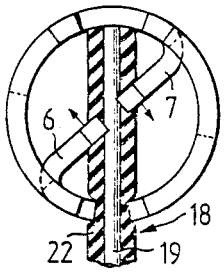
FIG. 5 is a top plan view of the contact of FIG. 1 with connected cable wire.

Referring to the drawings, in particular, the invention embodied therein comprises an electrical connector for effecting cutting and clamping of electrically insulated wire conductors which, in the embodiment of FIGS. 1–5, comprises a tubular member generally designated 1 which has inwardly bent wall pieces 2 and 3 which define cutting edges for cutting away insulation and for electrically connecting conductors 19 contained with insulation 22 as shown in FIG. 5. In accordance within the method of the invention, the wire conductor is aligned in respect to sleeve 1 to move downwardly in the interior of this sleeve in order to effect cutting off of its end and the clamping and electrical connection of the conductor during the downward passage of the wire in the tubular member 1.

The invention also includes a new and useful blank generally designated 1*a* which is cut from a single metal piece and which can be easily formed into the electrical connector.

In the FIGS. 1 to 6, a first embodiment of a cutting and clamping sleeve contact is shown. The sleeve 1 of the cutting and clamping sleeve contact has a round cross section, and has a wall 3 with an axial clamping slot 5 extending over the full wall length of the sleeve 1. The wall 33 also has a short separating slot 12 having a knife-type slot bottom or cutting edge 13. At the upper end of the clamping slot 5 and of the separating slot 12 are respective inclined insertion guides or sections 16 or 17.

Figure 6:
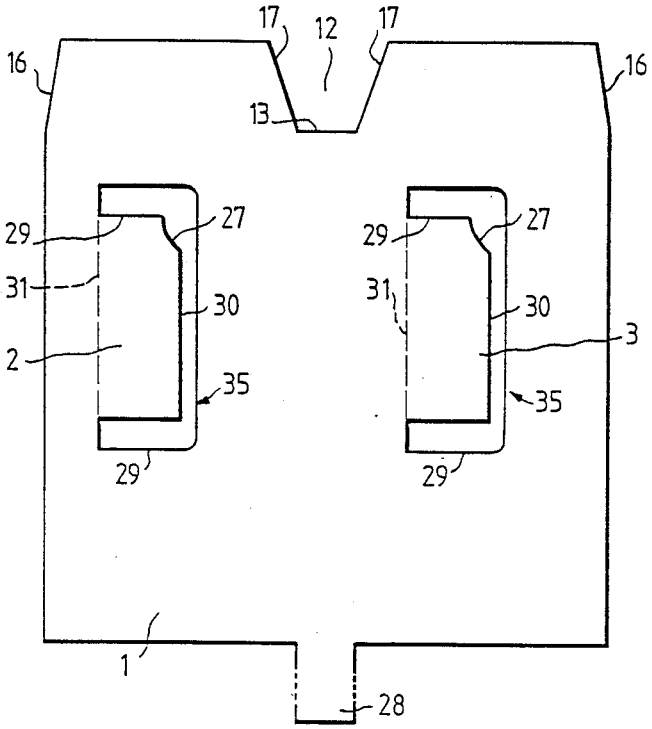
FIG. 6 is a view showing the formation of the contact.

According to the method of the invention, the wall 33 of the cutting and clamping sleeve contact made of a metal material is punched from a substantially rectangular sheet part or blank 1*a* and is, then, bent into the desired shape. As shown in FIG. 6, rectangular wall pieces 2 and 3 are cut out during punching in a center part of the blank of sleeve 1. The wall pieces 2 and 3 are cut free by means of U-shaped or C-shaped notches 35 having two narrow sides 29 and one longitudinal side 30 each. The longitudinal sides 30 of the wall pieces 2 and 3 form bending edges or hinges 31, around which the wall pieces 2 and 3 are bent into the interior of the sleeve 1. The pieces 2 and 3 form respective contact legs 6 and 7 for forming the cutting and clamping contact generally designated 4. As shown particularly in FIG. 4, the contact legs 6, 7 are bent at opposite positions, such that between the side walls or edges 14 and 15 which align with each other, a contact slot 8 is formed. The contact legs 6, 7 form, herein, at angle $\beta$ of approximately 45° to the plane 34 of the clamping slot 5.

According to FIG. 5, a cable wire 18 is inserted over the clamping slot 5 and the separating slot 12 between the inclined insertion sections 16 and 17, through which the cable wire 18 is introduced centrally into the slots 5 and 12. The cable wire axis of the cable wire 18 is, then, accurately placed on a plane 34 (FIG. 4). By means of a not-shown tool, the cable wire 18 is now pressed downward. The clamping slot 5, being elastic, holds the cable insulation and permits advance in the slot corresponding to the diameter of the cable wire 18. Depending on this, the two contact legs 6 and 7 are also elastic and enlarge, thus, to the slot width of the contact slot 8 according to the cable diameter to be connected. When the cable wire 18 is pressed further down, it will be introduced centrally in the clamping slots 5 due to inclined insertion sections or divergent guides 27, and the sharp edges 20, 21 of the side walls 14, 15 of the contact slot 8 cut first through the insulation 22 of the cable wires 18 and penetrate. Then, as shown in FIG. 5, the contact legs 6 and 7 are displaced at two diagonally opposite positions, into the conducting core 19 of the cable wires 18, thus creating an electrical connection between the sleeve 1 of the CC contact and the cable wire 18. The clamping slot 5 and the contact slot 8 are, thus, adapted in advantageous manner to the cable wire to be connected. At the knife-type slot bottom 13 of the separating slot 12, the end of the cable wire is cut off.

Figure 7:
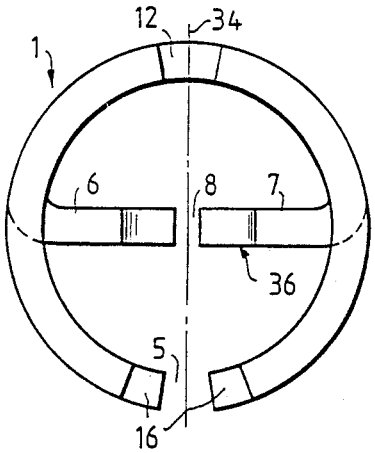
FIG. 7 is a top plan view on a cutting and clamping sleeve contact according to the second embodiment of a invention.
Figure 8:
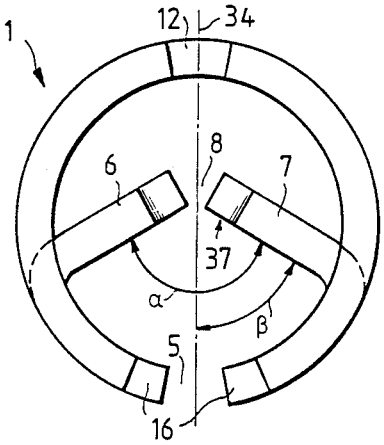
FIG. 8 is a top plan view of a cutting and clamping contact according to a third embodiment of the invention.
Figure 9:
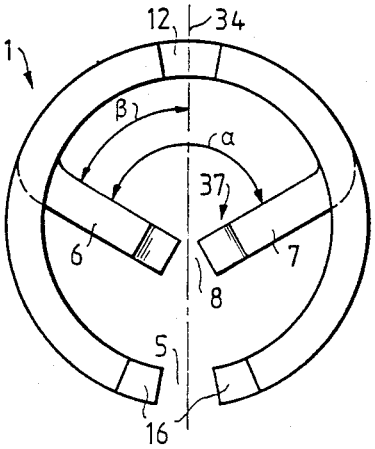
FIG. 9 is a top plan view of a cutting and clamping contact according to a fourth embodiment of the invention.
Figure 10:
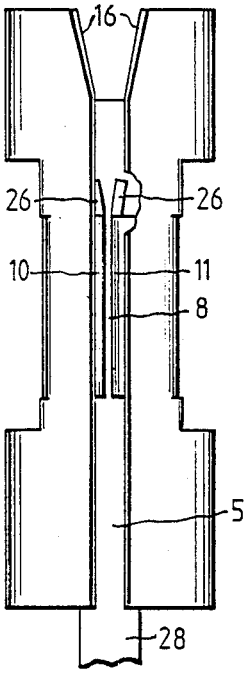
FIG. 10 is a front view of a cutting and clamping contact according to a fifth embodiment of the invention.
Figure 11:
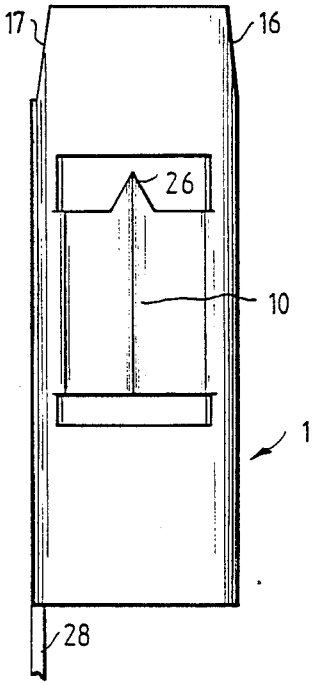
FIG. 11 is a side elevational view of the fifth embodiment of the invention.
Figure 12:
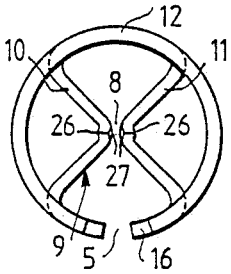
FIG. 12 is a top plan view of the fifth embodiment of the invention.

The two contact legs 6, 7 can form further angles to the plane 34 of the clamping slot 5 and of the contact slot 8. Such embodiments are shown in FIGS. 7 to 9. FIG. 7 shows a sleeve or tubular member 1, for which the contact legs 6, 7 form an angle of approximately 90° to the plane 34 of the clamping slot 5. Thereby, the fork contact 36 is formed. In FIG. 8, the contact legs 6, 7 form an angle $\beta$ of 45° to the plane 34 of the clamping slot 8, and in FIG. 9 also an angle of 45°, such that, thus triangular contacts 37 result, the contact legs 6, 7 of which are directed away from the clamping slot 5 or toward it. The triangular contact 37 according to FIG. 8 has a smaller spring travel and, thus, a larger spring force of the contact legs 6, 7 than the triangular contact shown in FIG. 9. This means that, when connecting a cable wire 18 of the triangular contact 37 shown in FIG. 9, the clamping slot 5 can widen up more than the triangular contact shown in FIG. 8, without affecting the contact slot 8.

Figure 13:
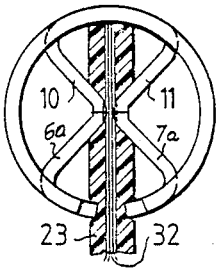
FIG. 13 is a top plan view of the fifth embodiment with connected cable wire.
Figure 14:
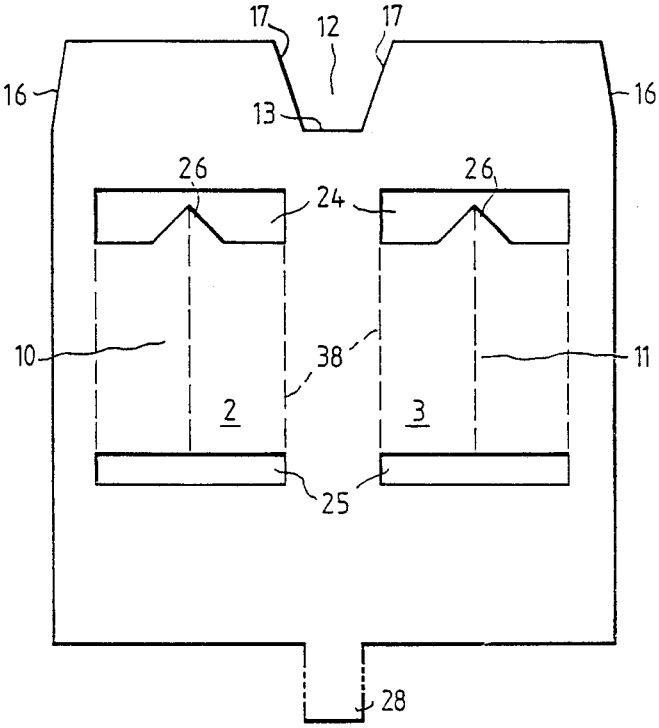
FIG. 14 is a view showing the formation of the contact of the fifth embodiment.

In the fifth embodiment according to FIGS. 10 to 14, a cutting and clamping sleeve contact with a surface contact 9 is shown, serving in particular for connecting stranded conductors 23 (FIG. 13). The development of this cutting and clamping sleeve contact is shown in FIG. 14. Here, two upper and two lower slots 24, 25 arranged in parallel and spaced to each other are punched from a sheet-metal, in the upper slot 24 central cutting tips 26 being provided. The wall pieces 2 and 3 formed between the upper and lower slots 24 and 25 are bent inward as angular wall pieces 10 and 11 at the bending edges 38 of the cutting and clamping sleeve contact, such that two V-shaped contact legs 6*a* and 7*a* are formed. The tips of the legs 6*a* and 7*a* are accurately opposite to each other and form the slot width of the contact slot 8. This cutting/clamping sleeve contact, too, has, like the embodiments mentioned above, an axial through-passing clamping slot 5 and a short guide and separating slot 12. When pressing-in the stranded conductor 23 into the sleeve contact, the cutting tips 26 are cut first through the insulation of the stranded conductor 23, until the slot walls 27 come under pressure into contact with the conductive individual strands 32 of the single or multi-stranded conductor and achieve an electrical connection between the cutting and clamping sleeve contact and the multi-stranded conductor 23. The stranded conductor 23 is, thus, connected without damaging or cutting the individual strands 32. Here, too, the contact slot 8 opens in spring-type manner, such that stranded conductors 23 with varying cable diameters can be connected.

In a embodiment, not shown, the cutting tips can be arranged displaced and opposite to each other, that the V-shaped contact legs 6, 7 exhibit varying leg lengths.

In all embodiments of the cutting-clamping sleeve contacts, there are extensions 28 at the bottom of the wall 33. The extensions 28 may support the conduits or may provide a connection to a second cutting/clamping sleeve contact, for example.

While specific embodiments of the invention have been shown and described in detail to illustrate the application of the principles of the invention, it will be understood that the invention may be embodied otherwise without departing from such principles.

What is claimed is:

1. An electrical connector for cutting and clamping electrical insulated wire conductors, comprising a substantially tubular member having open ends and an axially-extending through slot extending from one end to the other, first and second wall pieces located intermediate the length of said tubular member electrically connected to said tubular member and projecting into the interior of said tubular member and terminating in spaced-apart wall piece conductor edges defining a contact slot, the electrically insulated wire conductor being movable through the through-slot and between the conductor edges which are shaped to cut through the insulation of the wire and to make clamping electrical connection with said wall piece conductor edges, said tubular member defining said through slot being connected to said first and second wall pieces such that the widening of said through slot by an insulated wire conductor generates a proportional widening of said contact slot prior to the insulated wire engaging said conductor edges defining said contact slot.

2. An electrical connector according to claim 1, wherein said tubular member and said wall pieces are made of a single metal sleeve, said wall pieces being cut out of said sleeve and extending inwardly into the interior of said sleeve and including a pair of substantially diametrically opposite conductor entrance aligning guide slots defined at one of the ends of said tubular member, one of said entrance guide slots defining an entrance guide into said through slot, said entrance aligning guide slots orienting the wire conductor which is placed into and moved downwardly along the through slot, said spaced-apart wall piece conductor edges having knife-like edges so as to cut through the conductor insulation and being spaced sufficiently close so as to clamp the wire conductor therebetween in electrical connecting contact.

3. A cutting and clamping sleeve contact according to claim 1, wherein said wall pieces are disposed at an angle therebetween which varies from 0° up to 180°, said wall pieces having spaced-apart edges defining a contact slot which is arranged in substantially the same plane as said through slot.

4. A cutting and clamping sleeve contact for clamping and contacting a cable wire transverse to a sleeve axis, in particular for cable wires and telecommunications, comprising a metallic sleeve defining at least one insulation clamping slot with clamping edges extending downwardly and axially along its periphery and including cutting and clamping contacts at the interior of said sleeve, said cutting and clamping contacts being formed between inwardly bent wall pieces cut away from said sleeve and made of the same conductive metal material forming inwardly projecting legs with contact edges which are spaced apart and spaced to form said cutting and clamping contacts, engagement of a cable wire with said clamping slot urging said clamping edges apart causing said contact edges of said bent wall pieces to spread apart prior to engagement of the cable wire with said contact edges.

5. A cutting and clamping contact according to claim 4 wherein said sleeve has a round cross section.

6. A cutting and clamping sleeve contact according to claim 4, wherein said inwardly bent wall pieces are disposed at an angle of 180° to each other and said wall pieces have edges which define a slot therebetween which is disposed under an angle of approximately 45° to the clamping slot.

7. A cutting and clamping sleeve contact, according to claim 4, wherein said inwardly bent wall pieces are disposed at an angle of under 90° to each other and to the plane of the clamping slot of said sleeve and are symmetrical under an angle of approximately 45°.

8. A cutting and clamping sleeve contact, according to claim 4, wherein said inwardly bent wallpieces are directed with a contact slot therebetween away from the clamping slot of said sleeve.

9. A cutting and clamping sleeve contact according to claim 4, wherein said inwardly bent wall pieces cutting and clamping contacts form a contact slot aligned with said clamping slot of said sleeve.

10. A cutting and clamping sleeve according to claim 4, wherein said inwardly bent wall pieces are cut out by U-shaped notches from a wall of said sleeve.

11. A cutting and clamping sleeve according to claim 4, wherein said clamping slot extends over the full wall length of said sleeve and includes an inclined section at its upper end.

12. A cutting and clamping sleeve according to claim 4 wherein said contact slot formed between said contact legs exhibits inclined insertion section at its upper end.

13. A cutting and clamping sleeve, according to claim 4, wherein said inwardly bent wall pieces comprise two opposite angular wall pieces being cut out from a wall by two parallel cuts laterally to the axis and are pressed inward.

14. A cutting and clamping sleeve contact according to claim 13 wherein said angular wall pieces form a V-shape in axial cross section.

15. An electrical connector for use with insulated cable wire conductors comprising: first and second tubular wall portions; first and second wall pieces, and, spring means connected to each of said first and second wall pieces and connected to said first and second tubular wall portions, said spring means providing a spacing between said first and second wall pieces thereby defining a contact slot and providing a spacing between said first and second tubular wall portions thereby defining a clamping slot, said spring means for providing a widening of said contact slot upon engaging an insulated wire with said clamping slot, prior to engaging the insulated wire with said contact slot, thereby providing a prewidening of said clamping slot proportional to a widening of said clamping slot.

16. An electrical connector according to claim 1, wherein said wall pieces each are made up of two separate hinged wall parts which are directed inwardly from the tubular wall portions and have insulation cutting edges which meet together centrally within a tubular member formed by said tubular wall portions, said spring means being formed integral with said tubular wall portions, said spring means having a round cross section allowing adjustment of the width of the contact slot upon adjustment of the width of the clamping slot.

17. A method of establishing an electrical connection and a clamping of an electrically insulated wire conductor using a tubular member with walls defining a clamping slot along the surface thereof and an interior with spaced-apart clamping and conducting walls defining a contact slot, comprising providing a connection between the tubular member and each of the spaced apart conducting walls such that movement of the walls defining the clamping slot upon the insulated wire engaging the clamping slot, moves the spaced apart clamping and conducting walls a proportional amount prior to the insulated wire engaging the contact slot such that the width of the clamping slot determines the width of the contact slot placing the wire so that it is aligned with the prewidened contact slot and moving the wire downwardly in the contact slot so as to position the wire between the edges of the spaced apart conducting walls, pressing the wire downwardly so that the edges of the wall penetrate through the insulation so as to engage and electrically connect and clamp the conductor in the wire.

* * * * *